US005941030A

United States Patent [19]

Williamson

[11] Patent Number: 5,941,030

[45] Date of Patent: Aug. 24, 1999

[54] STEP SUPPORT BRACE FOR A SWIMMING POOL

[75] Inventor: James Michael Williamson, Fort Wayne, Ind.

[73] Assignee: Fort Wayne Pools, Inc., Fort Wayne, Ind.

[21] Appl. No.: 08/915,402

[22] Filed: Aug. 20, 1997

[51] Int. Cl.[6] ..... E04F 11/00; E04H 4/00

[52] U.S. Cl. ..... 52/182; 52/183; 52/184; 52/191; 4/506

[58] Field of Search ..... 52/182–191, 169.7, 52/8, 741.2, 250, 245; 182/228, 189, 220, 93, 97, 94, 228.1, 228.3, 228.4; 4/511, 496, 506, 504

[56] References Cited

U.S. PATENT DOCUMENTS

| | | | |
|---|---|---|---|
| 121,541 | 12/1871 | Nourse . | |
| 2,718,346 | 9/1955 | Galen . | |
| 3,028,016 | 4/1962 | Heftel . | |
| 3,346,317 | 10/1967 | Peggs . | |
| 3,744,198 | 7/1973 | Boassy . | |
| 3,755,981 | 9/1973 | West . | |
| 3,848,378 | 11/1974 | Witte . | |
| 4,343,120 | 8/1982 | Witte . | |
| 4,559,835 | 12/1985 | Rinke . | |
| 4,589,237 | 5/1986 | Dahowski . | |
| 4,747,238 | 5/1988 | Wikstrom et al. | 52/8 |
| 4,866,894 | 9/1989 | Brown . | |
| 4,873,802 | 10/1989 | Dahowski . | |
| 5,010,699 | 4/1991 | Maiuccoro et al. . | |
| 5,086,595 | 2/1992 | Maiuccoro et al. . | |
| 5,400,556 | 3/1995 | Favaron . | |
| 5,644,873 | 7/1997 | Bourgault | 52/169.7 X |
| 5,660,009 | 8/1997 | Cousin | 52/182 X |

*Primary Examiner*—Carl D. Friedman
*Assistant Examiner*—Laura A. Callo
*Attorney, Agent, or Firm*—Taylor & Associates, P.C.

[57] ABSTRACT

A step support brace especially for a swimming pool stair assembly includes vertically extending positioning posts that extend from the top of each horizontal riser portion of the brace associated with a stair tread some or all of which are slidably positionable from front to back along the respective horizontal riser portion to accommodate various stair module types and styles. The posts may also be cut off to a desired length in order to be received within an opening formed in the bottom side of the stair tread. The support brace also has a front hinge structure that allows the hingeable connection to another support brace to form a V-shaped configuration, thereby providing greater stair tread support if necessary.

15 Claims, 4 Drawing Sheets

STEP SUPPORT BRACE FOR A SWIMMING POOL

BACKGROUND OF THE INVENTION

1. Field of the Invention

The present invention relates to modular step systems and, more particularly, to support devices for modular steps especially of the prefabricated type utilized in swimming pools.

2. Description of the Related Art

In-ground swimming pools naturally have sides or sidewalls that are substantially vertical. The average swimming pool has vertical sidewalls that extend downwardly several feet from an upper surface of the pool deck. In view of this, swimming pools have some sort of ladder, steps, or the like to assist one in getting into and out of the pool. Generally, permanent steps are provided at the shallow end of in-ground swimming pools.

In some types of swimming pools, such as those constructed entirely of concrete, permanent steps are usually formed from bricks or tiles which are set in cement or concrete. However, many swimming pools today utilize prefabricated step modules that are carried to the site and readily installed therein. One type of step module is formed of acrylic and/or fiberglass laminates or vinyl covered metal. These types of step modules are relatively strong and will generally adequately support the weight of an adult. The drawback to such step modules is their tendency to delaminate, splinter, corrode, or puncture. Since these step modules are permanently installed in the sidewall of the swimming pool, replacement is cumbersome.

Because of these problems and other considerations, stair modules are now predominately prefabricated unitary structures formed of some type of suitable plastic composite or the like that can withstand temperature related expansion and contraction. However, such materials are generally relatively flexible so that the steps may yield under a person's weight, thereby giving the person an insecure feeling. Also, the structural integrity of such stair modules may be compromised.

Therefore, there have been devised various support structures to reinforce the steps of such prefabricated plastic stair modules. Stacked blocks or bricks have been used for support, but this requires footers and building the support from the ground up, requiring shims for leveling. Other examples of such support structures may include support posts having bearing plates or pads connected to their upper ends which are placed under the stair tread, or a longitudinal stiffening member which is bonded to the apices at the serrated surface on the underside of the stair tread. Another type of known support structure includes unitary support braces formed of a suitable plastic material which are strategically situated under the stair module treads. Each support brace has a plurality of horizontal step supports corresponding in number to the stair treads. Extending vertically from the horizontal step supports are integral tabs that are positioned to register unto slots formed within transverse stiffening ribs on the underside of the stair treads.

A problem with known support structures is that prefabricated stair modules are manufactured with varying stair tread widths, or vary in size by manufacturer. Thus, in order to accommodate all sizes and types of prefabricated stair modules, the prior art needed to have several sizes of support structure assemblies.

What is needed in the art is a stair support brace that can accommodate many sizes and styles of prefabricated stair modules, and is adaptable to various support configurations.

SUMMARY OF THE INVENTION

The present invention provides a support brace structure for swimming pool stair assemblies, especially prefabricated stair assemblies, adaptable to accommodate various sizes and styles of stair assemblies. The present support brace is also easily connectable with other support braces to form V-shaped support structures.

The invention comprises, in one form thereof a brace structure having a plurality of riser portions. A vertically extending post is associated with each riser portion, the posts adapted to be received in complementary holes in reinforcing ribs in the underside of the prefabricated stair assembly treads. At least several of the posts are slidably coupled to respective risers of the support brace such that the slidable posts can be positioned to accommodate various styles of prefabricated stair modules. The posts may be cut to length, depending on the height of the stair treads.

Additionally, the support brace has a hinge bracket disposed on the front portion that allows the support brace to be hingedly coupled to other support braces. In this manner, each pair of coupled support braces form a V-shaped support structure, as viewed from the top. A stake held against a rear portion of the support brace retains the support brace against the ground.

An advantage of the present invention is that a single support brace can accommodate stair modules of varying tread width.

Another advantage of the present invention is that a single support brace can accommodate stair modules of varying height.

Yet another advantage of the present invention is that support braces can be coupled to one another to form V-shaped supports for extra foundational support.

A further advantage is that the step support brace is configured to attach with an additional support brace which supports a concrete deck adjacent the top of the stair module to inhibit the concrete desk from settling.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
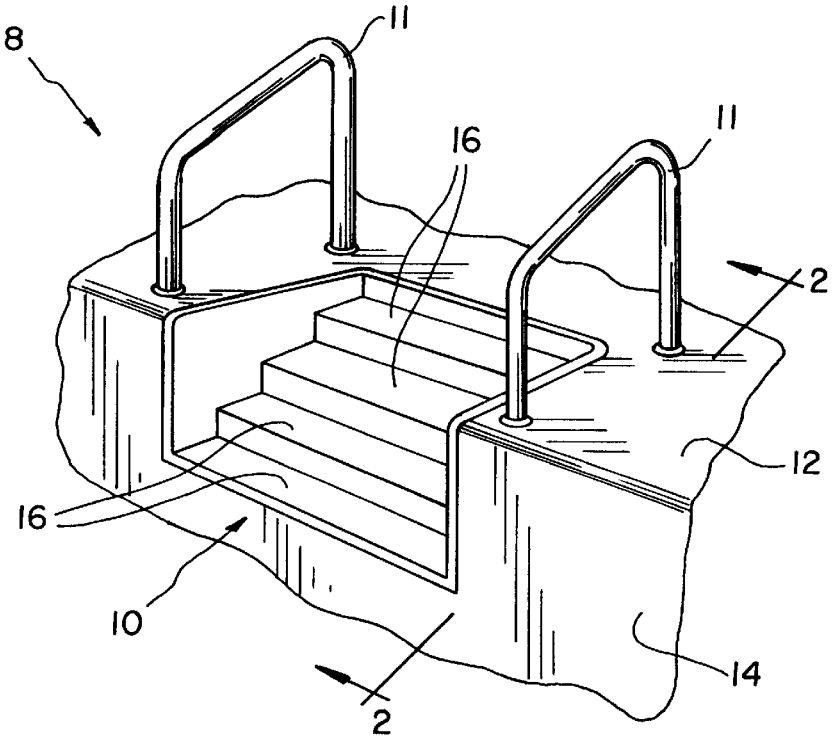
FIG. 1 is a fragmentary perspective view showing a portion of a swimming pool having typical steps or stairs in a wall thereof, the stairs being of the type to utilize the present invention.

Referring now to the drawings and particularly to FIG. 1, there is shown a fragmentary view of an end of a typical swimming pool, generally designated 8, having a typical prefabricated stair module, generally designated 10. The stair module 10 provides a transition between a top deck or upper surface 12 surrounding the swimming pool 8 and a sidewall 14 defining the interior perimeter of the swimming pool 8. As is also typical, a pair of handrails 11 are disposed on the upper surface 12, one handrail 11 located on either side of the step module 10 and adjacent thereto. The handrails 11 are provided to assist individuals into and out of the swimming pool 8. The stair module 10 has a standard four (4) steps or treads 16. However, it should be understood that the stair module 10 may have more or less treads 16.

Figure 2:
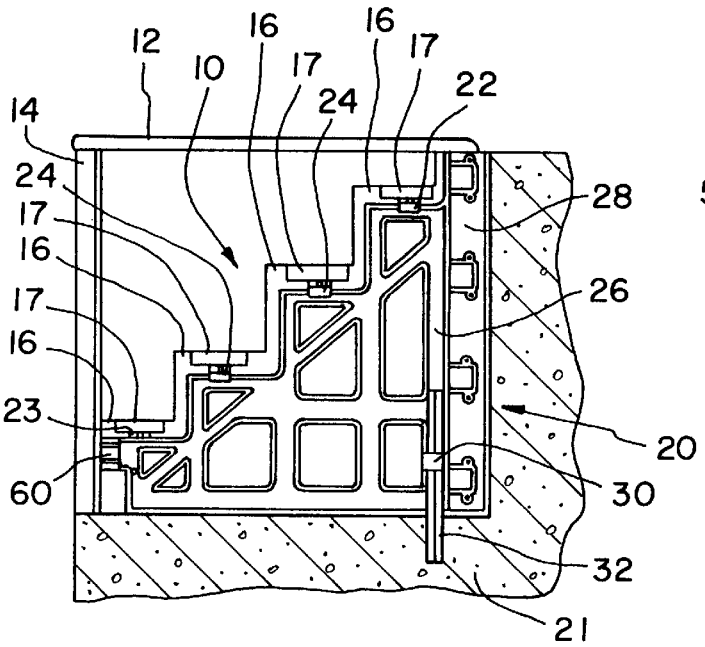
FIG. 2 is a side view of the steps of FIG. 1 supported by one embodiment of the support brace of the present invention, taken along line 2—2 of FIG 1.

As explained above the stair module 10 is fairly flexible upon the exertion of weight or force thereon and therefore needs an underlying support structure. Referring now to FIG. 2, there is depicted a side view of the stair module 10, a portion of which is being supported by an embodiment of the support brace of the present invention, generally designated 20. Each tread 16 of the stair module 10 includes a horizontal reinforcer 17 having an opening 18 therein (see FIG. 8). Situated under the stair module 10 is the support brace 20. As is easily seen, the support brace 20 spans the area between the ground (or foundation) 21 and the underside of each stair tread 16. It should be understood that while there is depicted only one support brace 20, multiple support braces may be used and/or necessary underneath and along the horizontal length of the stair module, depending on the horizontal length thereof and other factors relative to the stair module. Thus, the longer the horizontal length of the stair module, the more support braces that may be necessary or required for proper support. It is, however, not within the scope of this description of the present invention to determine and/or advise as to the number of support braces required and/or necessary to support a given stair module. The manufacturer of the stair module should be consulted for this determination.

Figure 3:
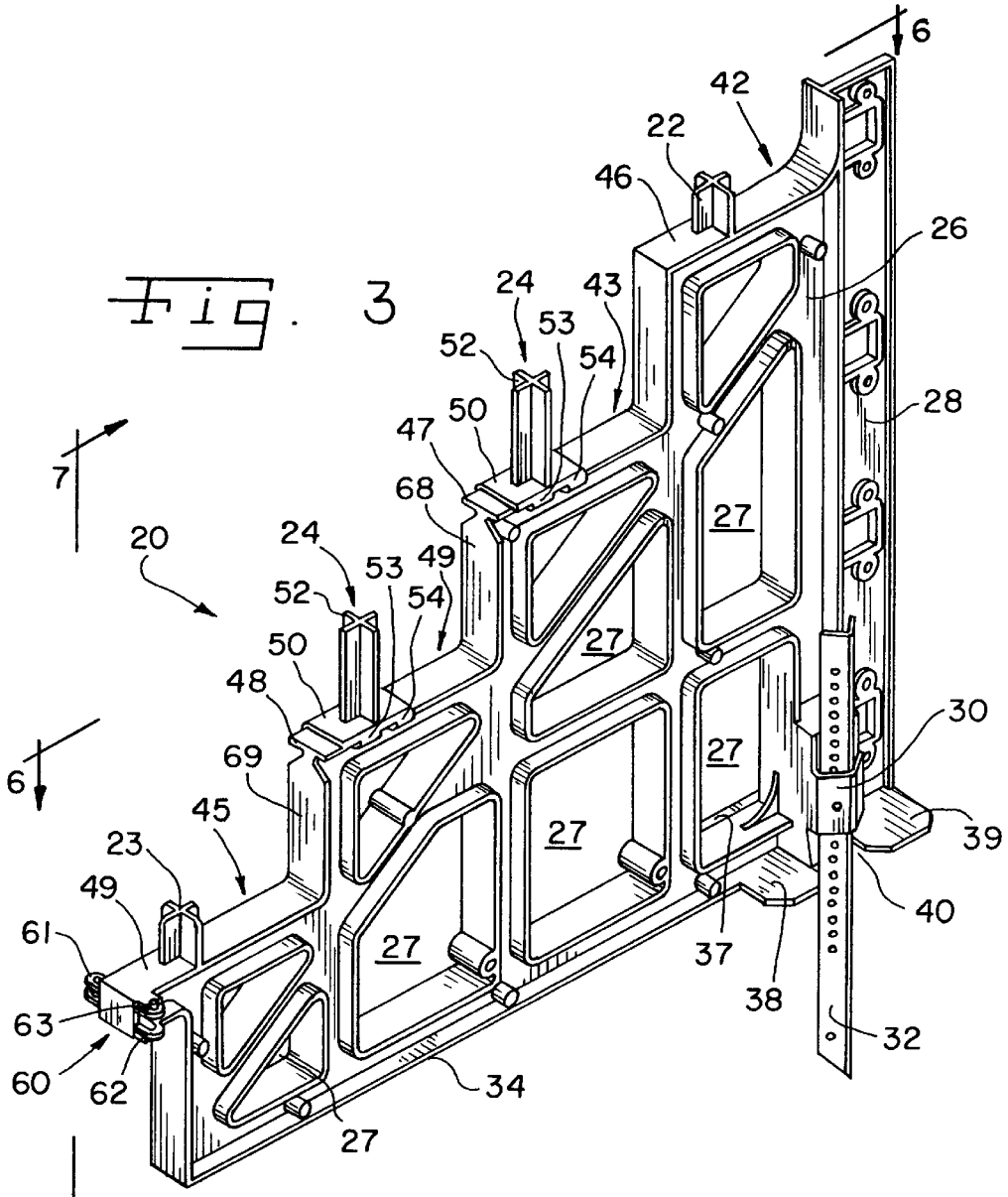
FIG. 3 is an enlarged perspective view of the support brace shown in FIG. 2.
Figure 6:
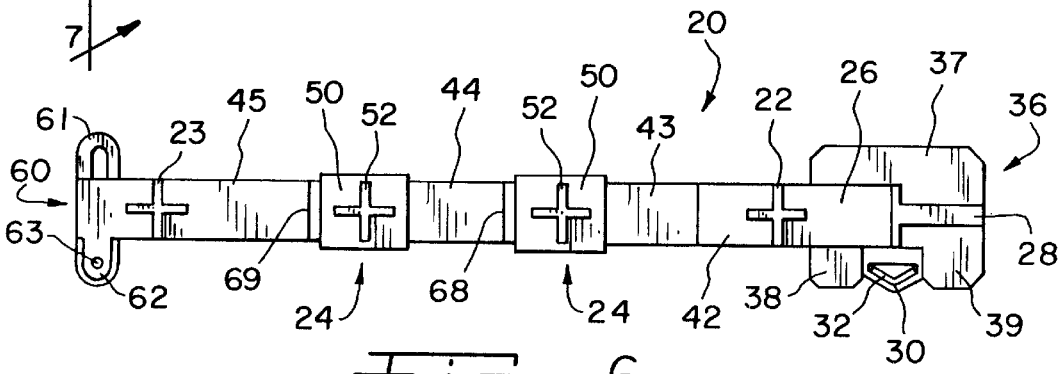
FIG. 6 is an enlarged top view of the support brace of FIGS. 2 and 3.
Figure 7:
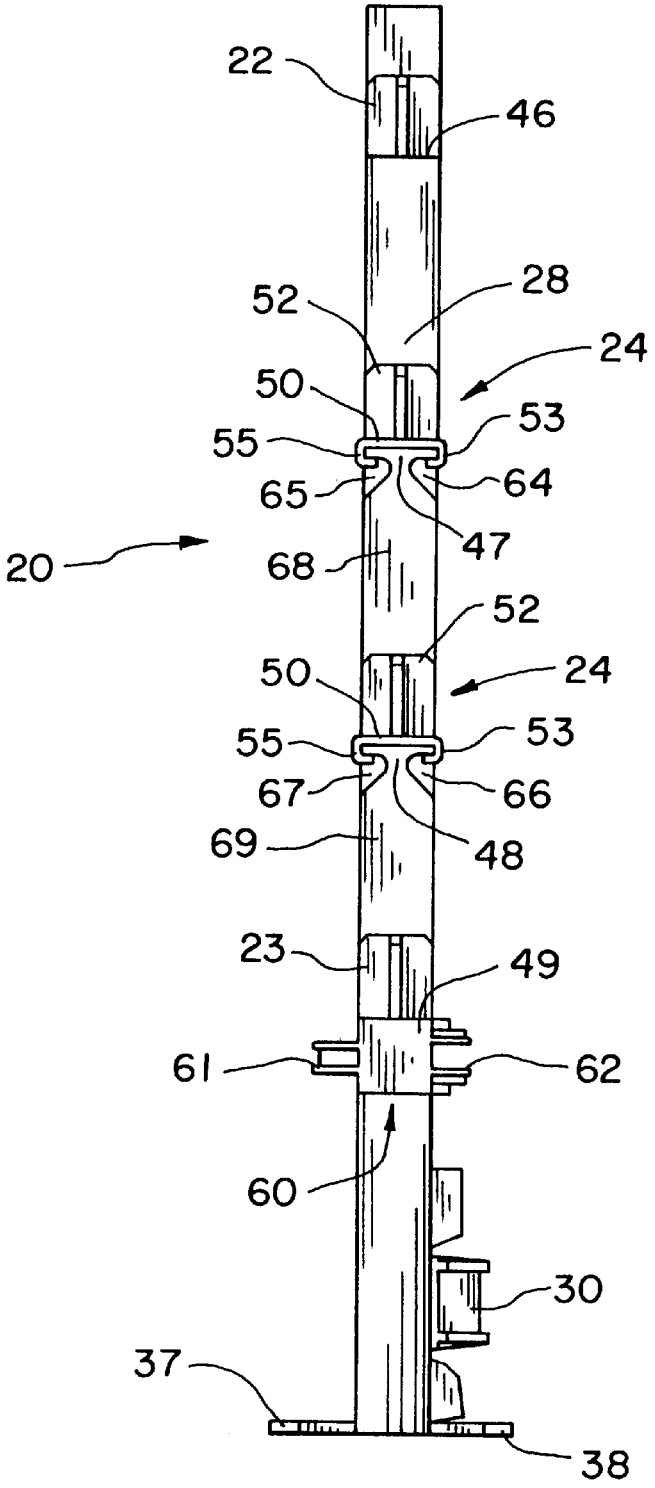
FIG. 7 is an enlarged front view of the support brace of FIGS. 2, 3 and 6.

With additional reference to FIGS. 3, 6 and 7 (FIG. 7 depicting the support brace 20 without a stake), the support brace 20 is shown in greater detail. The support brace 20 is defined by a frame structure 26 preferably composed of a plastic such as high density polyethylene (HDPE) or other suitable material, and can be manufactured or formed in various known ways. At the rear of the frame 26 is a vertically elongated member 28 that is adapted to be attached to a pool panel brace (not shown). A plurality of windows or openings 27 of various shapes are formed in the frame 26 to allow manufacture from a minimum amount of plastic but still maintain structural integrity. Adjacent the elongated member 28 is a protruding stake detaining structure 30 in which may be disposed a conventional metal stake 32. The stake 32 is driven into the ground or foundation, hereby holding the bottom surface 34 of the frame 26 in abutting contact therewith. Located at the bottom rear of the frame 26 is a lateral stabilizer generally designated 36 consisting of a first elongated flat flange 37 on one side of the frame 26, and a second and third flat flange 38, 39 on the other side thereof. The flanges 38, 39 define an opening 40 therebetween so as to allow the stake 32 to extend therethrough and into the ground.

The frame 26 of the support brace 20 has a tiered upper surface defining four risers or tread supports, generally respectively designated from the uppermost tread support downward, 42, 43, 44, and 45. These tread supports correspond in number to the number of steps or treads 16 of the stair module 10. Thus, it should be understood that the support brace 20 may include more or less risers to correspond to the number of treads of the stair module, the embodiment shown in the present figures being only exemplary. Each riser 42, 43, 44, and 45 is defined at least in part by a ledge or shelf, respectively numbered 46, 47, 48, and 49, that laterally extends beyond the frame structure 26 on either side thereof, as is best depicted in FIG. 7.

Integrally formed on the upper surface of the shelf 46, being the uppermost shelf, is a vertically extending X-shaped post structure 22. Integrally formed on the upper surface of the shelf 49, being the lowermost shelf, is a vertically extending X-shaped post structure 23. Preferably, the posts 22, 23 are fixed in their position on the respective shelf 46, 49 to correspond to in position the reinforcer opening of the uppermost stair tread of the stair module, and the reinforcer opening of the lowermost stair tread of the stair module, which is best seen in FIG. 2. The posts 22, 23 are adapted to register in the openings in the respective tread reinforcer 17.

Figure 4:
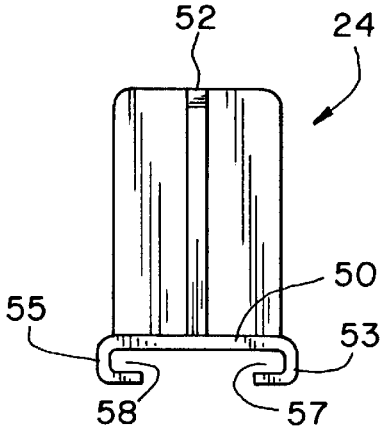
FIG. 4 is an enlarged front view, relative to FIG. 3, of an embodiment of the suitable support post of the support brace.
Figure 5:
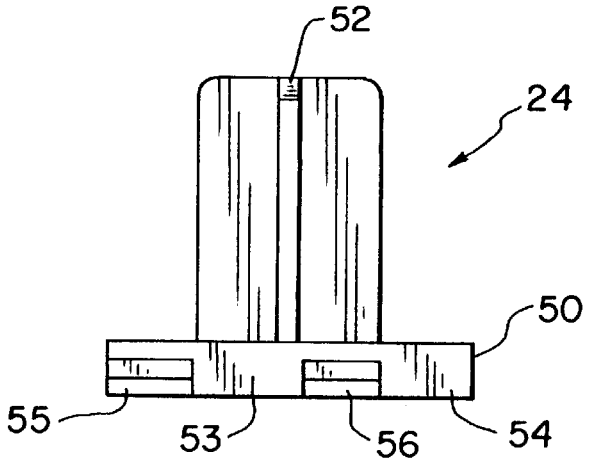
FIG. 5 is an enlarged right side view, relative to FIG. 3, of the slidable support post of the support brace.

Situated on each of the middle shelves 47, 48 of the frame 26 is a slidable post 24 preferably formed of plastic, such as HDPE, or other suitable material. Each post 24 is movable or positionable along the length of their respective shelf 47, 48 in order to accommodate the particular stair module 10 to be supported. Referring to FIGS. 4 and 5, an enlarged slidable post 24 is depicted in a front and side view respectively, relative to FIG. 3. The post 24 includes an integral base 50 having a central X-shaped vertical structure and two pairs of downwardly and inwardly curved flanges respectively labeled 53, 54 on one side, and 55, 56 on the other side. The flange pair 53, 54 are offset or staggered relative to the flange pair 55, 56. As best seen in FIGS. 4 and 7, the flange pair 53, 54 forms a channel 57 into which one side of the respective tread support shelf extends while the flange pair 55, 56 forms a channel 58 into which the other side of the respective tread support shelf extends, thereby slidably retaining the post 24 thereon. It is apparent that the posts 24 are preferably manufactured separately and positioned onto the tread support. The posts 24 are able to be placed on the shelves 47, 48 by respective notch pairs 64, 65, and 66, 67 located in the front vertical risers 68, 69 of the shelves 47, 48 respectively.

Figure 8:
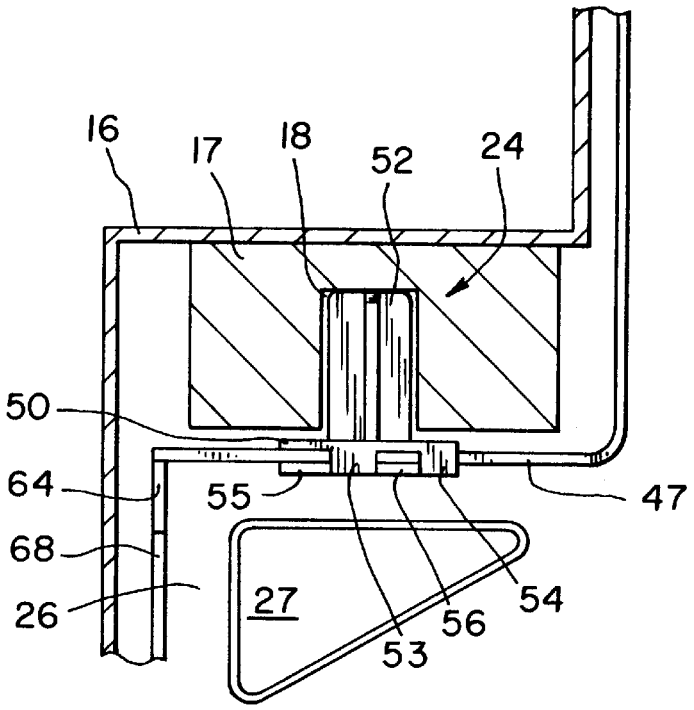
FIG. 8 is an enlarged partial side cross-sectional view of a support post of the support brace situated in a horizontal tread support of one of the stair treads of the stair module.

Referring now to FIG. 8 one of the slidable posts 24 is depicted extending into an opening 18 of the tread reinforcer 17 of the stair tread 16. Regardless of the location of the opening 18, the post 24 is slidably positionable to be received therein. Additionally, it should be noted that all of the posts 22, 23, 24 preferably have an initial vertical height with a sufficient length that may be cut down to fit any particular situation, dependent upon the depth of the corresponding opening 18.

The frame 26 also includes a hinge connection arrangement 60 on a front end of the frame 26 consisting of an inner hinge flange structure 61 on one side thereof and an outer flange structure 62 on the other side thereof. The hinge connection arrangement 60 is adapted to connect a like support brace 20 onto either or both sides of a first or main support brace. The inner hinge flange structure 61 is matingly received within the outer hinge flange structure 62 and held together by a pin 63. In this manner, a V-shaped structure, as viewed from the top, is formed between the first or main support brace and the connected support brace. The hinge connection arrangement 60 thus allows the width of the "V" formed therebetween to be variable depending on the desired condition or support arrangement.

While this invention has been described as having a preferred design, the present invention be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support brace for a swimming pool stair assembly, the stair assembly having a plurality of tiered stair treads each having an opening in the underside thereof, the support brace comprising:

a frame, an upper surface of said frame defining a plurality of tiered risers corresponding in number to the plurality of tiered stair treads, said risers being configured to support the stair treads; and a plurality of posts, each said post vertically extending from a corresponding said riser and receivable in the opening of the corresponding stair tread, at least one of said posts being slidably positioned on a respective said riser, said at least one post being slidable in a substantially horizontal direction.

2. The support brace of claim 1, wherein said post associated with an uppermost one of said risers is fixed in its position thereon, said post associated with a lowermost one of said risers is fixed in its position thereon, and said posts associated with intermediate risers are slidably positioned on their respective said riser.

3. The support brace of claim 1, wherein said riser associated with said slidably positioned post includes a horizontally extending shelf as an upper surface, said slidably positioned post including a base abutting said shelf, a first flange extending from a side of said base and surrounding a side of said shelf, and a second flange extending from another side of said base and surrounding another side of said shelf, said first and second flanges slidably retaining said base on said shelf.

4. The support brace of claim 3, wherein said shelf extends outwardly from said frame on either side thereof, and said first and second flanges engage respective sides of said shelf.

5. The support brace of claim 1, wherein said frame and said posts are formed of high density polyethylene.

6. The support brace of claim 1, wherein said slidable post includes a base abutting a respective said riser, said base having a first pair of outwardly and downwardly extending flanges on one side thereof, and a second pair of outwardly and downwardly extending flanges on another side thereof opposite said first pair of flanges, said first pair of flanges forming a first channel between themselves and an underside of said base, said second pair of flanges forming a second channel between themselves and said underside of said base, said post retained on said riser by said first and second channels.

7. A support brace for a swimming pool stair assembly, the support brace comprising:

a pair of frames, each said frame having a plurality of tiered risers on an upper surface thereof and extending from a front end to a rear end, a lowermost riser adjacent said front end, and an uppermost riser adjacent said rear end;

a plurality of posts, each said post vertically extending from a respective said riser; and a pair of hinge structures respectively disposed at said front ends of said frames, said hinge structures being hingedly coupled to each other and allowing relative substantially horizontal, pivotal movement between said pair of frames about a substantially vertical axis.

8. The support brace of claim 7, wherein said hinge structure comprises a first flange structure on a side of one of said frames; and a second flange structure on a side of an other of said frames, said second flange structure pivotally connected with said first flange structure and secured via a pin.

9. The support brace of claim 7, further comprising a stabilizer disposed at a bottom surface of said frame at said rear end, said stabilizer defined as a first foot laterally outwardly extending from said bottom surface on one side of said frame, and a second foot laterally outwardly extending from said bottom surface on another side of said frame opposite said one side.

10. The support brace of claim 7, wherein said frame, said posts, and said hinge structures are formed of high density polyethylene.

11. A support brace for a swimming pool stair assembly, the stair assembly having a plurality of tiered stair treads each having an opening in the underside thereof, the support brace comprising:

a frame having a front end and a rear end, an upper surface of said frame defining a plurality of tiered risers from said front end to said rear end and corresponding in number to the plurality of tiered stair treads, said risers being configured to support the stair treads;

a plurality of posts, each said post vertically extending from a corresponding said riser and receivable in the opening of the corresponding stair tread, at least one of said posts being slidably positionable along a respective said riser; and a hinge structure disposed at said front end and configured to be hingedly coupled to a second hinge structure of a like second support brace, to thereby allow relative substantially horizontal, pivotal movement between said support braces.

12. The support brace of claim 11, wherein said post associated with an uppermost one of said risers is fixed in its position thereon, said post associated with a lowermost one of said risers is fixed in its position thereon, and said posts associated with intermediate risers are slidably positioned on their respective said riser.

13. The support brace of claim 12, wherein said riser associated with said slidably positioned post includes a horizontally extending shelf as an upper surface, said slidably positioned post including a base abutting said shelf, a first flange extending from a side of said base and surrounding a side of said shelf, and a second flange extending from another side of said base and surrounding another side of said shelf, said first and second flanges slidably retaining said base on said shelf.

14. The support brace of claim 11, wherein said slidable post includes a base abutting a respective said riser, said base having a first pair of outwardly and downwardly extending flanges on one side thereof, and a second pair of outwardly and downwardly extending flanges on another side thereof opposite said first pair of flanges, said first pair of flanges forming a first channel between themselves and an underside of said base, said second pair of flanges forming a second channel between themselves and said underside of said base, said post retained on said riser by said first and second channels.

15. The support brace of claim 11, wherein said hinge structure comprises a first flange structure on a side of one of said frames; and a second flange structure on a side of an other of said frames, said second flange structure pivotally connected with said first flange structure and secured via a pin.

* * * * *

UNITED STATES PATENT AND TRADEMARK OFFICE

CERTIFICATE OF CORRECTION

PATENT NO. : 5,941,030

DATED : August 24, 1999

INVENTOR(S) : James M. Williamson

It is certified that error appears in the above-identified patent and that said Letters Patent is hereby corrected as shown below:

COLUMN 2

Line 34, delete "desk" and substitute --deck-- therefor; and

Line 52, delete "suitable" and substitute --slidable-- therefor.

Signed and Sealed this

Ninth Day of January, 2001

*Attest:*

Q. TODD DICKINSON

*Attesting Officer*

*Commissioner of Patents and Trademarks*